United States Patent [19]

Morris

[11] Patent Number: 4,482,017

[45] Date of Patent: Nov. 13, 1984

[54] LIQUID SUPPLY TANK

[75] Inventor: Karl J. Morris, Alexis, Ill.

[73] Assignee: Alexis Fire Equipment Co., Alexis, Ill.

[21] Appl. No.: 356,526

[22] Filed: Mar. 9, 1982

[51] Int. Cl.[3] ..... A62C 27/20

[52] U.S. Cl. ..... 169/24; 137/351; 137/433; 137/574; 137/587; 137/590; 220/86 R

[58] Field of Search ..... 137/351, 433, 574, 587, 137/590; 141/198, 201, 204, 216; 169/24; 280/5 D; 220/85 VR, 85 VS, 86 R, 202

[56] References Cited

U.S. PATENT DOCUMENTS

| | | | |
|---|---|---|---|
| 1,117,431 | 11/1914 | Olds | 141/204 X |
| 1,352,792 | 9/1920 | Day | 220/86 R |
| 1,608,226 | 11/1926 | Mauran . | |
| 1,756,976 | 5/1930 | Ehlers | 220/86 R |
| 1,850,075 | 3/1932 | Fox | 169/24 X |
| 2,037,774 | 4/1936 | Fox | 169/24 |
| 2,088,226 | 7/1937 | Arvintz | 220/86 R X |
| 2,241,857 | 5/1941 | Hisaw | 169/24 |
| 2,246,616 | 6/1941 | Cherry | 169/24 X |
| 2,423,879 | 7/1947 | De Frees | 137/21 |
| 2,437,618 | 3/1948 | Schottgen et al. | 222/389 |
| 2,715,488 | 8/1955 | Conlon | 141/201 X |
| 4,050,857 | 9/1977 | Leach | 417/309 |

OTHER PUBLICATIONS

National Fire Protection Association, Inc., Automotive Fire Apparatus 1979, NFPA 1901, Chapter 6.

*Primary Examiner*—Gerald A. Michalsky
*Attorney, Agent, or Firm*—Neuman, Williams, Anderson & Olson

[57] ABSTRACT

In a mobile liquid supply tank, such as a water tank for use as fire fighting apparatus, a hollow tank is provided with at least one fill neck and an overflow relief valve on the upper surface portion of the tank. A pressure fill valve is also provided near the lower portion of the tank for emptying or filling the tank. Each fill neck includes a buoyant float disposed within the tank that seals the fill neck when the tank is substantially filled with liquid. The overflow valve, adapted to open when the pressure within the tank exceeds a predetermined value, is preferably located in a recessed portion of the tank. A drain pipe extends from that recessed portion through the tank and exits from the bottom of the tank to discharge liquid overflow away from the forward path of the rear traction wheels of the transport vehicle.

12 Claims, 4 Drawing Figures

LIQUID SUPPLY TANK

BACKGROUND OF THE INVENTION

The present invention relates generally to liquid supply tanks and fill and overflow systems in such tanks. More specifically, it relates to a fill and overflow system in a water tank adapted for use as a mobile water supply suitable to assist fire fighting apparatus or the like.

In rural and other areas not adequately served by a fire hydrant or other adequate water supply, it is necessary to transport water to the scene of a fire by the use of a mobile water supply vehicle. Upon arriving at the fire, the water in the supply tank is emptied into a reservoir for future use, or it is pumped directly to the fire hoses for attacking the fire. After emptying, the water tank is returned to the water source for refilling and travels back to the fire if additional water is still required.

Factors affecting the utility of a water supply tank include how quickly the water may be unloaded at a fire, how quickly the tank may be refilled, and the speed with which the transporting vehicle can shuttle between the water source and the fire. One known method of increasing the tank filling and evacuation speed is to provide a free breathing tank with uncapped venting ports. This construction allows a free flow of air between the tank and the atmosphere, thereby minimizing the partial vacuum formed within the tank chamber during evacuation which restricts the speed of water evacuation, and minimizing the pressure buildup within the tank chamber during filling which restricts the speed of filling. Such a free breathing construction also minimizes stress on the tank itself resulting from the alternate positive and negative pressures experienced by the tank as the chamber walls are placed under tension or compression. During maneuvering of the transporting vehicle en route to the fire, however, this open vent construction allows water to spill from the venting ports of the water supply tank, especially during high performance maneuvering. This situation is hazardous since water spilled in front of the traction wheels of the water supply vehicle could cause a skid or loss of traction. Spilled water also endangers the general road traffic. And in cold weather, water spill is particularly hazardous as freezing temperatures cause the water to form sheets of ice on the road surface, creating extremely poor driving conditions. The combination of water spillage and freezing temperatures may also cause controls on the external surface of the tank to freeze or become ice covered. If the tank is used to supply liquids for other uses, spillage poses even further problems and complications if the liquid in the tank is other than water, such as a corrosive or a petroleum product.

To prevent liquid spillage during maneuvering, it is common to provide the supply tank with lockable venting ports that may be closed during transport. This system introduces a delay in the filling and evacuation operations, however, as it requires the vents to be opened before the tank may be filled or emptied. And, if the vents are not opened, the filling and evacuation operations are slowed due to the abnormal pressure or vacuum created within the tank, as explained above. Further, structural deformation of the tank may occur during filling or evacuation as the pressure or vacuum buildup within the tank causes the tank to balloon or collapse when the venting ports are closed, preventing release of excess pressure and liquid overflow or the admission of atmospheric air.

SUMMARY OF THE INVENTION

The present invention represents an advance in the art of liquid supply tanks by meeting several objectives not addressed by prior art systems. It is the general object of the present invention to remedy the above-described problems inherent in known liquid supply tanks, particularly as used in mobile water supply fire fighting apparatus.

More specifically, it is an object of the present invention to provide a liquid supply tank having a fill and overflow system that will provide venting during high volume filling and evacuation, and release overflow as necessary when the tank is filled.

Another object of the present invention is to provide a liquid supply tank that directs overflow away from the forward travel path of the traction wheels of a transporting vehicle supporting the tank.

Another object of the present invention is to provide venting automatically during filling and evacuation of the liquid supply tank.

A further object of the present invention is to permit high performance maneuvering of the transporting vehicle without spillage from the supply tank.

Further objects appear in the detailed description of the invention and in the claims.

The present invention is a novel liquid supply tank. A hollow tank is providing having an upper and lower portion, with the lower portion adpated to be placed upon a support frame. A fill neck means and an overflow relief valve means are located on the upper portion of the tank, and each communicates with the interior thereof. A float valve means seals the fill neck when the tank is substantially filled. Additionally, a valve means is located on the bottom portion of the tank for emptying or filling the tank. A drain means directs overflow from the relief valve to a predetermined location.

BRIEF DESCRIPTION OF THE DRAWINGS

For a more complete understanding of the invention, reference will now be made by way of example to the accompanying drawings in which.

DETAILED DESCRIPTION OF THE INVENTION

Figures 1, 3, 4:
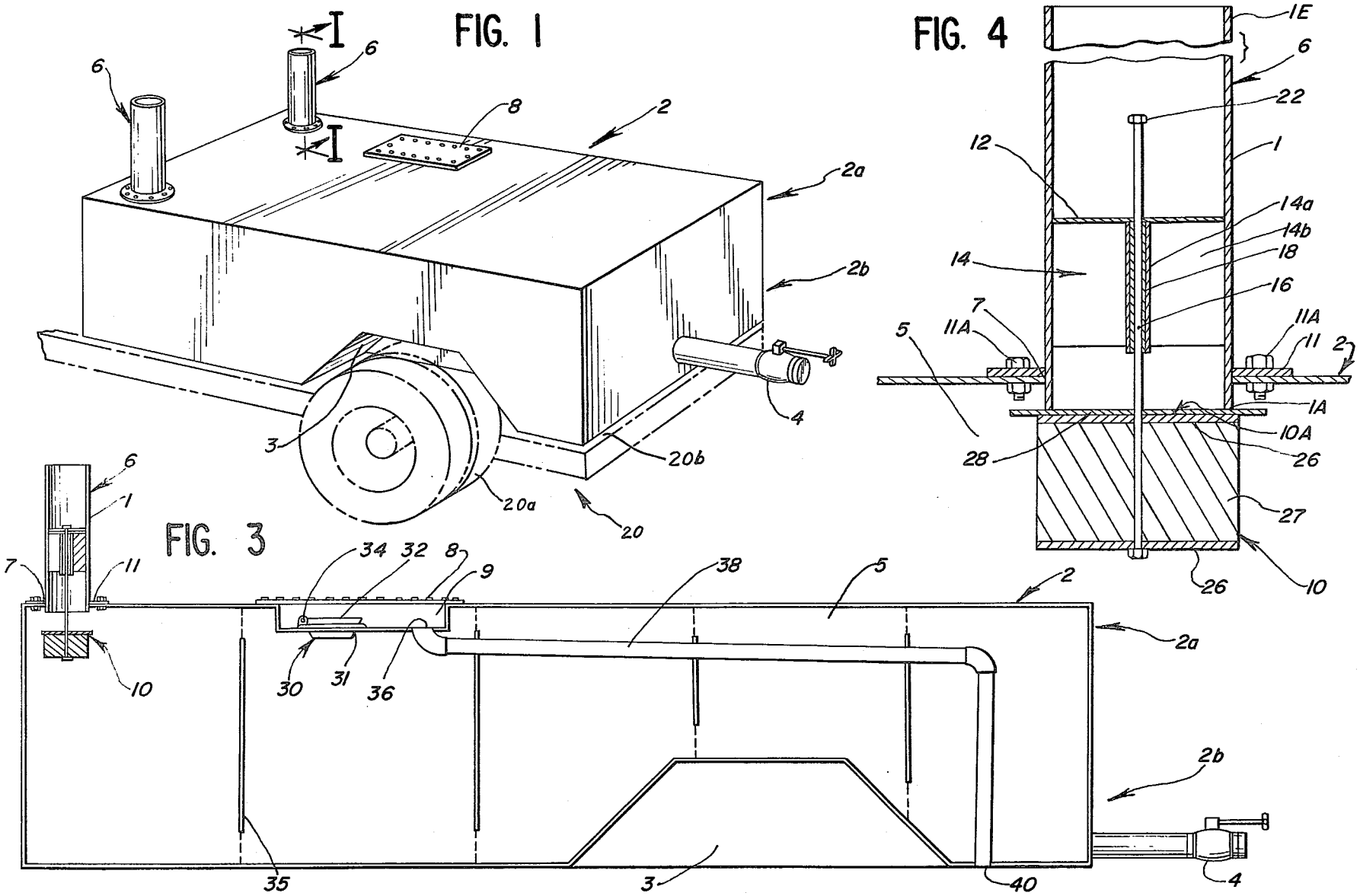
FIG. 1 is a perspective view from the rear of a liquid supply tank incorporating the preferred embodiment of the present invention.
FIG. 3 is a vertical sectional view of the supply tank of FIG. 2 taken along line II—II of FIG. 2.
FIG. 4 is a vertical sectional view of a fill neck in accordance with the present invention, taken along line I—I of FIG. 1.

Referring now to the drawings in general and FIG. 1 in particular, shown is a liquid supply tank 2 adapted for use, for example, as a mobile water supply fire fighting apparatus. The tank may have a generally rectangular shape, and includes an upper portion 2A and a lower portion 2B. The tank 2 is adapted for placement on a mobile frame apparatus 20 (shown in broken line) and attachment thereto in any convenient manner. Should the mobile frame 20 have rear traction wheels 20*a*, they will fit within wheelwells 3 formed in the rear of each side of the supply tank. To cushion the supply tank during transport, there is typically placed between the tank and mobile frame a shock absorbent material 20*b* such as wood or rubber. The water tank 2 is shown provided with a substantially horizontal upper surface to allow for storage of hoses, water pumps and other fire equipment.

Figure 2:
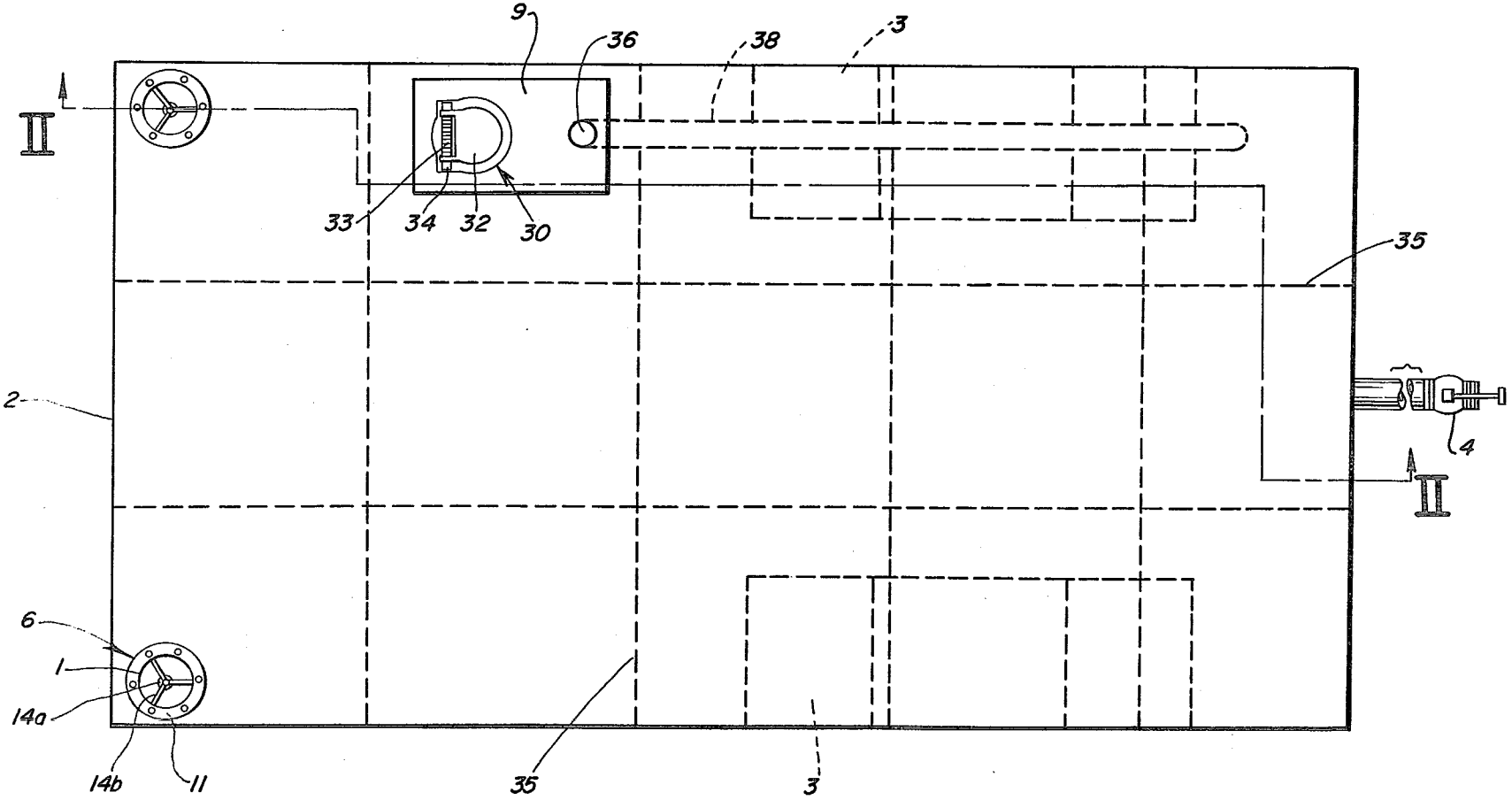
FIG. 2 is a top plan view of the supply tank of FIG. 1 showing in phantom lines additional tank details.

In the preferred embodiment of the present invention, supply tank 2 may be filled through forwardly located vertical fill neck means 6, which includes a float valve assembly (See FIGS. 2-4). If the tank should overflow during filling, the excess liquid is released by an overflow relief valve, located in a recessed portion of tank 2 beneath cover plate 8, and drainage system as described below. The water tank may be emptied through pressure fill valve 4, shown located on the lower portion 2B at the rear of the tank, which may also serve as a fill valve. Of course, all components of the water supply tank and the fill and overflow system should be formed of nonrusting or noncorrosive materials.

Referring now to FIGS. 2-4, fill neck 6 includes a generally vertical, cylindrical fill pipe 1 having an annular flange 11 that is attached to the upper surface 2A of the tank by way of bolts lIA or other suitable fasteners. The pipe 1 communicates with the interior cavity 5 of tank 2 through port 7. The fill pipe 1 extends a convenient distance above tank 2 to support a float assembly, and extends a short distance into the interior of the tank, having a positive, unobstructed edge lA against which float assembly 10 may seat. The interior of the fill pipe includes a plurality of radially extending support webs 14*b* that meet near the center of the pipe. The outer radial edge of each web is attached to the interior wall of the fill pipe, and the inner radial edges meet to form a tubular guide 14*a* coaxial with the fill pipe. A tubular insert 18 is coaxial with and disposed within the guide 14*a*. A center rod 16 is freely slidably disposed within the tubular insert 18. A float valve assembly 10 is secured to the lower end of the rod 16 within the tank cavity 5 immediately below the unobstructed edge lA of the fill pipe 1. The slidable center rod 16, formed from stainless steel or some other nonrusting material, is provided at its upper end with stopping means 22 to prevent the rod from sliding through the insert 18, which is preferably made of a suitable corrosion-free material having a relatively low coefficient of friction, such as delrin or nylon. The open support structure of supporting webs 14 thus maintains slidable rod 16 aligned coaxially with the axis of fill pipe 1 yet minimizes backup of liquid during the filling operation, owing to the small cross-sectional area exposed by the webs. In addition, the webs provide a benefit during the filling operation by dispersing the incoming liquid, thereby reducing the liquid's inertia incident on float assembly 10 and minimizing possible damage thereto. A removable screen 12 may be placed over supporting web 14 to further increase liquid dispersion and also to prevent debris from entering the water tank. If desired, a suitable coupling or funnel may be attached to the exposed end 1E of the fill pipe to facilitate the filling operation.

Secured to the lower end of center rod 16, float valve assembly 10 is disposed within the tank 2 and beneath fill neck 6 as illustrated in FIG. 3 (in its open position) and in FIG. 4 (in its closed position). It is normally held open by its own weight or the force of incoming liquid during the filling operation, and is forced closed when the tank is substantially filled with liquid. The float valve assembly 10 is substantially composed of buoyant material 27 having a closed cell construction or being otherwise treated so that it does not loose its buoyancy over time by the absorption of liquid. I have found that polystyrene is a suitable material for use in a water supply tank, but any float material is suitable provided its density is less than that of the tank liquid. The buoyant material 27 may be sandwiched between suitable end plates 26 secured to center rod 16, although other securing means may be employed, of course. The upper surface 10A of float valve assembly 10 is supplied with a seal 28 which seats against the bottom end 1A of fill pipe 1 when the float valve assembly is in its raised position. The seal 28 is made from a flexible material, such as live rubber, which forms a near complete seal with fill pipe 1 and prevents the build up of mineral deposits on the seal by its flexing action. In operation, the float valve assembly is forced into the closed, sealing position of FIG. 4 when the liquid level within tank 2 is sufficiently high that the buoyancy of the float valve assembly overcomes the weight thereof. When the tank 2 is not filled with liquid, center rod 16 and float valve assembly 10 are pulled down by their weight to the extent permitted by stopping means 22 and supporting web 14, thereby opening fill pipe 1 for filling or venting purposes.

An overflow relief valve 30, attached to the upper portion 2A of the tank, communicates with the interior 5 of tank 2 through port 31 and includes a cap 32 that is normally urged to its closed position owing to a conventional torsion spring means 33 located at hinge 34. Other methods may be employed to apply a closing force to cap 32; for example, cap 32 may be urged closed by attaching a predetermined weight thereon. The purpose of overflow valve 30 is to vent excess pressure within the tank during pressurized refill operations, preventing deformation of the supply tank. When filling from a pressurized source such as a fire hydrant or a transfer pump, often at pressures up to 100 p.s.i.g., the water tank will balloon if not provided with some means to expel excess water when pumping does not stop immediately after the tank becomes filled. In the present invention, this means is provided by overflow valve 30 which opens when the pressure within tank 2 exceeds a predetermined value, for example 5 p.s.i.g., which value is chosen to be well below the pressure at which the tank begins to deform.

In the preferred embodiment, the overflow relief valve is located in a liquid confining recess 9 in the upper portion 2A of the tank. A cover plate 8 is releasably retained in sealing relation to the tank to contain any liquid expelled through the relief valve. This recess includes a drain 36 connected to an overflow pipe 38, which terminates at a discharge outlet 40. In addition to containing and collecting overflow from valve 30 for draining through drain 36, recess 9 serves to locate overflow valve 30 beneath the upper surface of tank 2 so that it does not protrude to snag or cause injury to personnel and equipment. Furthermore, the overflow valve is itself protected from damage by equipment being handled at the upper surface of tank 2. Overflow pipe 38 is enclosed within the supply tank and drains through discharge outlet 40 located behind wheelwells 3. Thus, when filling the tank, discharge outlet 40 directs any overflow away from the forward path of the rear traction wheels of the vehicle. The overflow pipe is also enclosed within tank 2 for its own protection and to prevent interference with fire fighting activity on and around the supply tank.

The overflow relief valve 30 and float valve assemblies 10 effectively seal the tank when it is filled with liquid and being transported to the scene of a fire. Thus, spillage is avoided during high performance maneuvering en route to the fire, and road traffic is not endangered by the loss of traction created by such spillage. At this point, another benefit of the present fill and overflow system can be explained. In freezing temperatures, apparatus pumping systems are typically drained of water and kept dry to prevent damage thereto. Before use, however, the drained pumping system must be primed or saturated with water, either by gravity flow from the water supply tank or by a separate pump priming system. If the gravity flow method is used (for example when the separate priming systems fails) and the water tank is inadequately vented, saturation of the pump is slowed, thereby delaying application of the water to a fire. The present invention overcomes this problem. When a water tank incorporating the described fill and overflow system is completely filled from a pressurized source, the fill necks 6 are closed by operation of float valve assemblies 10, and overflow relief valve 30 permits the tank to maintain a nominal, positive pressure on the water within. This positive pressure facilitates proper saturation of the pumping system during the priming operation.

To minimize the inertial effect of moving liquid within the tank during maneuvering, baffles 35 are typically installed within the tank cavity. These partitions, opened at the top and bottom to allow air and liquid flow between compartments during filling and emptying, restrict movement and flow of the liquid while the vehicle is in motion to prevent the accumulation of inertia which may adversely affect the handling characteristics of the transporting vehicle.

Pressure fill valve 4 is located at the lower portion of liquid supply tank 2 and communicates with the interior 5 of the tank. This valve is adapted to empty tank 2 or, alternately, to fill the tank from a pressurized source such as a hydrant or transfer pump means. When withdrawing liquid from the tank through valve 4 at high flow rates, there is a tendency for a partial vacuum to form within the tank, thereby inhibiting evacuation of the tank. This condition is minimized in the present invention by the automatic operation of the float valve assembly 10 of fill necks 6. As liquid is withdrawn from tank 2, the float valve assembly automatically opens under its own weight when the liquid level falls within the tank, and fill necks 6 become breathing vents that equalize the pressures inside and outside the tank.

While the preferred embodiment of the invention has been shown, it will be understood, of course, that the invention is not limited thereto since modifications may be made by those skilled in the art, particularly in light of the foregoing teachings. It is, therefore, contemplated by the following claims to cover any such modifications as incorporate those features which constitute the essential features within the true spirit and scope of the invention.

What is claimed is:

1. In fire fighting apparatus including a liquid supply tank mounted on a mobile support, the liquid supply tank comprising:

a hollow liquid supply tank having an upper portion and a lower portion, said lower portion mounted on said mobile support;

fill neck means located on said upper tank portion and communicating with the interior thereof, said fill neck means including buoyant float valve means responsive to the liquid level within said tank for sealing said fill neck means when said tank is substantially filled with liquid and when the liquid within said tank is in motion toward said fill neck means, and automatically unsealing said fill neck means when the liquid in said tank is withdrawn from said buoyant float valve means;

overflow relief means located on said upper tank portion and communicating with the interior thereof, said relief means adapted to open when the interior tank pressure exceeds a predetermined value;

drain means connected to said relief means to direct overflow tank liquid from said relief means to a predetermined location; and valve means located on said lower tank portion and communicating with the interior thereof for selectively emptying and filling said tank.

2. A liquid supply tank according to claim 1 wherein said upper tank portion is substantially flat.

3. A liquid supply tank according to claim 1 including a plurality of fill neck means.

4. A liquid supply tank according to claim 1, wherein said fill neck means includes a substantially vertical pipe having an annular flange fastened to said upper tank portion.

5. A liquid supply tank according to claim 1 wherein said float valve means includes float means; and support means secured within said fill pipe and adapted to slidably position said float means substantially coaxially with respect to said fill pipe.

6. A liquid supply tank according to claim 5 wherein said support means includes a hollow guide pipe secured within said fill pipe and coaxially located; and an elongated center rod having its lower end disposed below the interior end of said fill neck means and a stop means disposed at its upper end, said rod slidably disposed within said guide pipe.

7. A liquid supply tank according to claim 6 wherein said float means is disposed at the lower end of said center rod.

8. A liquid supply tank according to claim 5 wherein said float means comprises buoyant means having a density less than the density of the liquid in the tank, and flexible seal means located above said float means and adapted to seal against the opening defined by the bottom of said fill pipe when said float valve is in its raised position.

9. A liquid supply tank according to claim 1, including a selectively removable, cleanable screen means located within said fill neck means.

10. A liquid supply tank according to claim 1 wherein said upper tank portion includes a recessed collection portion which houses said overflow relief means.

11. A liquid supply tank according to claim 10 wherein said drain means includes a receiving end communicating with said recessed collecting portion and a discharge end emptying outside said tank.

12. A liquid supply tank according to claim 11 wherein said drain means is substantially enclosed within the interior of said tank.

* * * * *